United States Patent [19]

Burn et al.

[11] Patent Number: 5,014,172

[45] Date of Patent: May 7, 1991

[54] SPACE LIGHTING

[75] Inventors: Michael Burn, Woodbridge; Colin Adby, Oxford, both of England

[73] Assignee: Light Years Ahead Limited, Woodbridge, England

[21] Appl. No.: 523,327

[22] Filed: May 14, 1990

Related U.S. Application Data

[62] Division of Ser. No. 297,837, Jan. 17, 1989.

[30] Foreign Application Priority Data

Jan. 20, 1988 [GB] United Kingdom ..... 8801221
Mar. 1, 1988 [GB] United Kingdom ..... 8804847

[51] Int. Cl.[5] ..... F21V 13/06

[52] U.S. Cl. ..... 362/284; 362/223; 362/282; 362/322

[58] Field of Search ..... 362/222, 223, 277, 280, 362/322, 323, 328, 329, 282, 319, 284

[56] References Cited

U.S. PATENT DOCUMENTS

| | | | |
|---|---|---|---|
| 2,301,419 | 11/1942 | Lew | 362/280 |
| 3,769,503 | 10/1973 | Kim | 362/280 |
| 4,323,955 | 4/1982 | Mark | 362/280 X |
| 4,598,344 | 7/1986 | Nadler | 362/282 X |

*Primary Examiner*—Stephen F. Husar
*Attorney, Agent, or Firm*—Charles E. Baxley

[57] ABSTRACT

A space lighting fitting comprises a support, lamp holder means and light directing means adjustable between first and second positions giving direct and indirect lighting respectively.

8 Claims, 6 Drawing Sheets

FIG.12.B

SPACE LIGHTING

This is a divisional of application Ser. No. 297,837, filed Jan. 17, 1989.

BACKGROUND TO THE INVENTION

This invention relates to a space lighting, that is to say lighting for illuminating spaces such as rooms of dwelling houses or offices or theatres or even for outdoor spaces such a patios.

It is conventional to provide lighting fittings which have shades, reflectors diffusers and the like, and many designs of fittings are available which give indirect lighting as by directing light from a lamp in the fitting on to a wall or ceiling, while many other designs provide direct lighting by allowing light from the lamp to fall directly, either with or without an intervening diffuser or lensed refractor, into the space to be illuminated.

In particular with tubular lamps such as fluorescent tubes, fittings comprise a reflector behind the tube with an optional diffuser prismatic controller, or lensed refractor in front of the tube, although often tubular lamps are used to give indirect lighting by being concealed within pelmets or under soffits or within alcoves where, however, they may provide direct illumination on to objects displayed within the alcove, but some indirect illumination into the room space beyond the alcove by reflection from the walls and ceiling of the alcove.

Although certain shaded lamps can be adjusted, for example, desk and table lamps, to direct light at a working area, mostly lamps are designed to be permanently positioned to provide direct illumination or indirect illumination in order to achieve a permanent, desired lighting effect in a room, office or other space.

The fittings for tubular lamps, such as fluorescent tubes, have been on the whole typical of such permanently deployed lighting fittings.

The present invention provides improved lighting fittings that give more flexibility of lighting effect whereby a single lamp can be permanently or adjustably deployed in a variety of configurations.

SUMMARY OF THE INVENTION

The invention comprises a space lighting fitting comprising a support, lamp holder means and light directing means adjustable between first and second positions giving direct and indirect light respectively.

The light direction means may be adjustable to a position or positions between said first and second positions to give a combination of direct and indirect light, and may be continuously adjustable between said first and second positions or to one preset position therebetween or several such.

The support may be adapted for attachment or to be suspended from a wall or ceiling surface and in the first said position giving direct lighting, the light directing means being positioned between the said surface and the lamp held in the lamp holder means whilst in the said second position giving indirect lighting, the light directing means being positioned so as to reflect light back to said surface.

The fitting may, however, also be arranged on a free standing floor standard or mounted on furniture or equipment.

Said light directing means may comprise a pivoted member, and may indeed comprise two pivoted members connected to pivot simultaneously from said first position in which they cooperate to light seal or substantially light seal the lamp holder means from the support to said second position in which they cooperate to reflect light from a lamp in said lamp holder means towards the support. Said two pivoted members may pivot simultaneously about spaced apart axes, which axes may be either side of said lamp holder means. The two pivoted members may be formed after the fashion of clamshell members.

The two pivoted members may be operated by a common actuator to move between their said first and second positions. Said actuator may comprise a ratchet operating in pinions associated with the two pivoted members.

It may be arranged, however, that one of said pivoted members can be moved independently of the other; where a common actuator is provided it may also be arranged that one or either one of the pivoted members can be released from the actuator or can be actuated thereby to move oppositely to the other so that both direct and indirect light effects can be varied as desired.

The support may comprise a reflective member directed towards a lamp when mounted in the lamp holder.

The fitting may comprise a diffuser, prismatic controller or lensed refractor through which the fitting transmits light to give direct lighting referred to. Said diffuser, controller or lensed refractor may be located on the side of the second position of the light directing means remote from the lamp holder whereby the light directing means in said second position are between the lamp holder and the diffuser, controller or lensed refractor.

In another arrangement, the light directing means may be fixed and the lamp holder movable, or both the lamp holder and the light directing means may be movable.

The fitting may be adapted for a tubular lamp such as a fluorescent tube.

The light directing means may be supported for rotation about the lamp holder means and the fitting may comprise adjustment means adapted to rotate the light directing means about the lamp holder means, the lamp holder means and the light directing means being coaxial and the adjustment means comprising a ring surrounding said lamp holder means and fixed with respect to said light directing means, and locating means to hold the ring and hence the light directing means in a set position. Said locating means may comprise a motor connected to drive the ring, which may be by meshing directly or indirectly with it.

The fitting may be adapted for elongate lamp means (such as a fluorescent tube) held at both ends in said lamp holder means, said light directing means being supported for rotation about the lamp holder means at both ends. Said locating means may act on rings at both said ends and may comprise a lay shaft extending parallel to said elongate lamp means.

Said light directing means may surround a lamp held in said lamp holder means.

Said light directing means may comprise reflector means, which may comprise an arcuate member having a lesser curvature than the cylinder, which is the locus of its rotation about the lamp holder means.

Said light directing means may comprise diffuser, prismatic controller or lensed refractor means, which may be circular, cylindrical and coaxial with their axis of rotation about the lamp holder means.

Said light directing means may comprise a circular cylindrical shell surrounding a lamp in said lamp holder means.

BRIEF DESCRIPTION OF THE DRAWINGS

Embodiments of space lighting fittings according to the invention will now be described with reference to the accompanying drawings, in which.

DETAILED DISCLOSURE OF THE PREFERRED EMBODIMENTS

Figure 1:
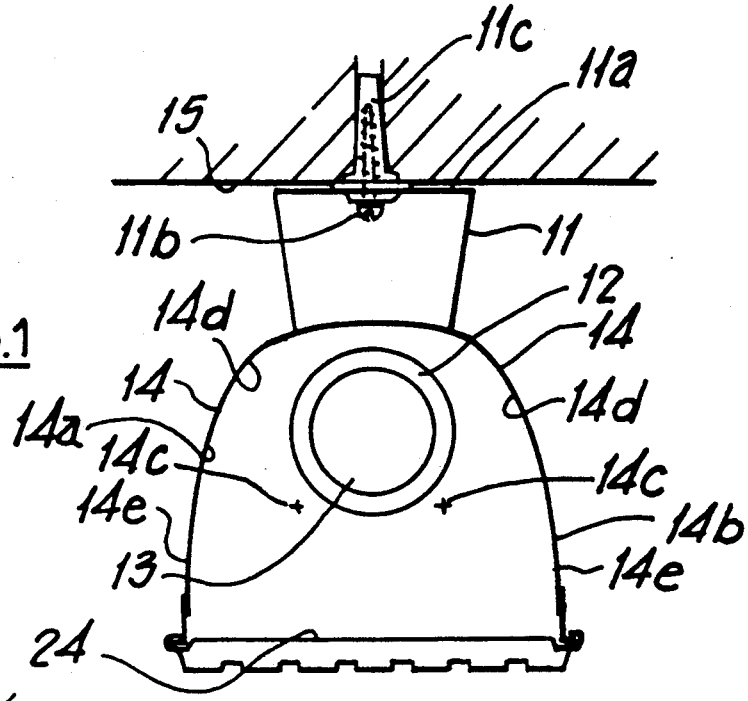
FIG. 1 is a cross-section of a ceiling fitting adapted for a fluorescent tube in a first position.

The space lighting fitting illustrated in the drawings comprises a support 11, lamp holder means 12 for holding a fluorescent tube 13 and light directing means 14 adjustable between first (FIG. 1) and second (FIG. 2) position giving direct and indirect lighting respectively.

Figure 2:
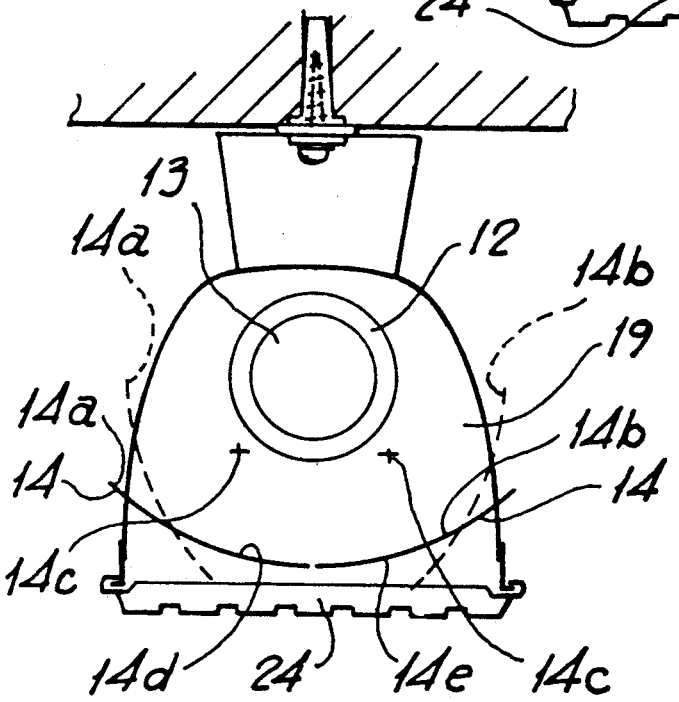
FIG. 2 is a cross-section like FIG. 1 in a second position.

The light directing means 14 are continuously adjustable through all positions between the said first and second positions so as to give different combinations of direct and indirect lighting. FIG. 2 illustrates, in broken line, one such intermediate position.

Figure 3:
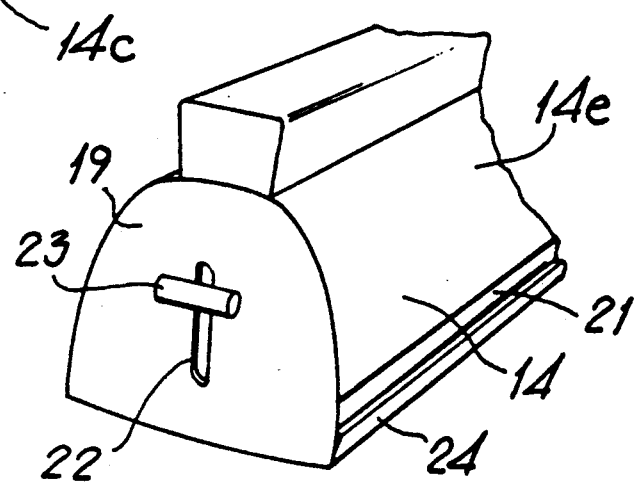
FIG. 3 is a perspective view of one end of the fitting illustrated in FIGS. 1 and 2.

The support 11 which can also house the transformer and starter arrangements for the tube 13 is adapted, as by the usual provisions such as slots and holes 11*a* (see particularly FIG. 3), for attachment (as by screws 11*b* into plugs 11*c*—see FIG. 1 and 2) to a ceiling 15 (as illustrated) or a wall (as by turning the fitting as viewed in FIG. 1 and 2 through 90° so that the face 11*d* is vertical). In the said first position illustrated in FIG. 1, giving direct lighting, the light directing means 14 are positioned between the ceiling 15 and the lampholder means 12, whilst in the said second position (FIG. 2), giving indirect lighting, the light directing means 14 are positioned so as to reflect light back to the ceiling 15 (or, as it may be, the wall).

Said light directing means comprised two pivoted members 14*a*,14*b* connected to pivot simultaneously from said first (FIG. 1) position in which they cooperate to effect light sealing or substantial light sealing of the lamp holder means 12 from the support 11 (and the ceiling 15 or wall) to said second position (FIG. 2) in which the cooperate to reflect light from the lamp 13 towards the support 11 and hence the ceiling 15 (or wall).

The two pivoted members 14*a*,14*b* are pivoted about one of two spaced apart axes which include pivot points 14*c* disposed respectively on either side of the tube 13. The pivoted members 14*a*,14*b* are formed after the fashion of clamshell members and their surfaces 14*d* directed towards the tube 13 are reflective as by being silvered or polished metal. They may be made of extruded aluminium and may have an outer surface 14*e* which is matt anodized.

Figure 4:
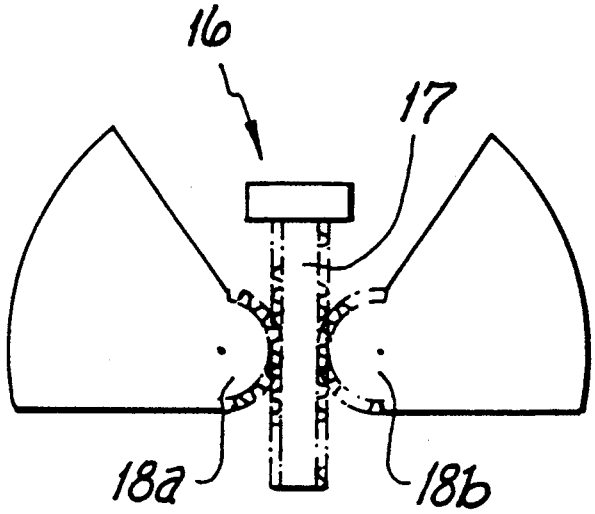
FIG. 4 is an elevation illustrating a ratchet and pinion actuating arrangement.

The members 14*a*,14*b* are operated by a common actuator 16, FIG. 4, to move between their said first and second positions. The actuator 16 comprises a ratchet 17 operating on pinions 18*a*,18*b* associated with the members 14*a*,14*b* respectively. The mechanism is located at either end of the fitting in end caps 19 secured to the support 11 and braced by lengthwise extending ribs 21. The end caps 19 have slots 22 in which the ratchets 17 slide, grips 23 projecting through the end slots 22 in the caps 19 to the exterior of the fitting for operating the actuators 16.

The members 14*a*,14*b* may, however, be operated by individual actuators so as to be capable of independent movement, or one or either of them may be arranged to be disengaged from the common actuator 16 so as to remain fixed while the other is moved. In this latter case, the disengagement may be arranged to take place in either extreme position and/or any intermediate position. The members 14*a*,14*b* could also, if desired, be arranged to move in opposite directions so that one of them is in the position giving direct light while the other is in the position giving indirect light. It will be readily appreciated that the actuator mechanism may be adaped to cater for these variations.

The ribs 21 serve as locaters for the edges of the members 14*a*,14*b* in their extreme positions and also serve to support a diffuser, prismatic controller or lensed refractor 24 through which the fitting gives direct lighting and which serves to conceal the members 14*a*,14*b* when they are in their second position in which they lie between the lamp holder 12 and the diffuser, controller or lensed refractor 24. The latter may be made from an acrylic extrusion or moulding.

The members 14*a*,14*b* may, if desired, by holding the ratchet 17 in intermediate positions, be set at any desired position between said first and second positions so that they can operate in a purely direct or a purely indirect lighting mode or in a combination direct and indirect lighting mode.

Different arrangements can be envisaged in which two or more fluorescent tubes or other tube or striplight units are mounted in the fitting, and different designs of light directing means and actuating means therefor can be envisaged which may be made of materials and have finishes different from those described without departing from the inventive concept. Moreover, the concept is not necessarily limited to use with fluorescent or other tube or striplighting—incandescent bulbs or quartz halogen or other lighting units could be accommodated and the fitting need not in any such cases be essentially elongate as is required for striplighting —the concept can apply equally well to point light sources as for example a standard incandescent bulb by having for example a hemispherical clam shell comprised of members pivotable from a lower (if a ceiling fitting) indirect lighting position in which they reflect light back up to the ceiling and prevent it reaching the ground directly to an upper, direct lighting position in which they prevent light from falling on the ceiling and reflect it down to the ground, permitting light to reach the ground directly from the bulb.

Moreover, the diffuser, prismatic controller or lensed refractor could be placed on the inside surface of the members 14a,14b instead of or even in addition to the diffuser or refractor as shown—it should perhaps be noted here that a diffuser is not necessarily the same thing as a prismatic controller or lensed refractor. A diffuser may be a plain or ribbed translucent member, whereas a prismatic controller or lensed refractor may be adapted not to diffuse light but to focus it.

The actuator 16 may, of course, be motorised, and actuated remotely especially if the fitting is ceiling mounted as by a wall switch or an infra-red signalling device or actuated by some automatic control arrangement such as a photocell which adjusts between direct and indirect light to suit ambient light conditions, or by a control signal for operating a plurality of lamp together, as in an office of factory, operating on, for example, a 0.5 to 10 volt d.c. current superimposed on or sent separately from the a.c. mains supply.

Figure 5:
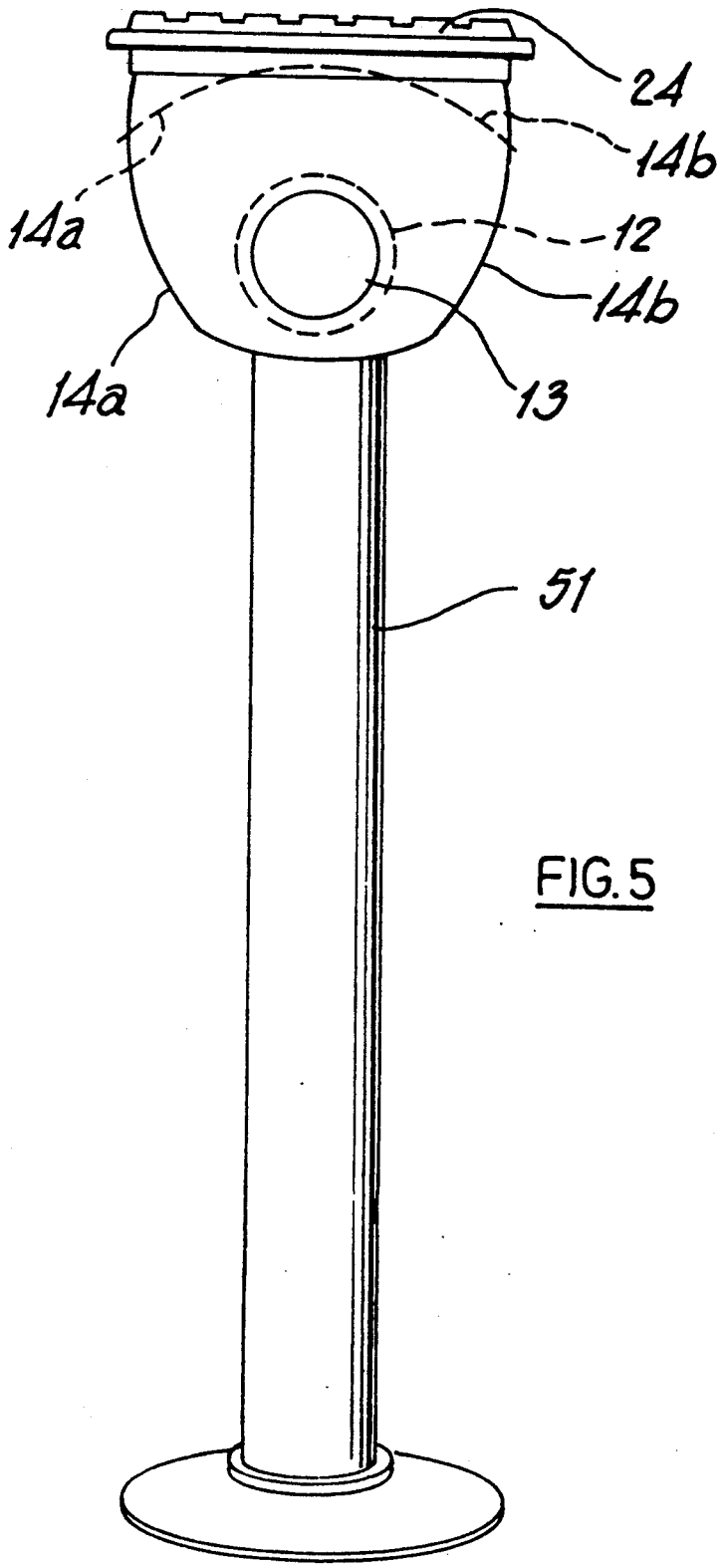
FIG. 5 is a view of a floor standard embodying the fitting.

FIG. 5 illustrates a floor standard 51 carrying a fitting generally as illustrated in FIGS. 1 to 4 but mounted with the diffuser, controller or refractor 24 uppermost. Here, direct light would be thrown downwardly when the members 14a,14b are uppermost (broken line), indirect light being available by directing the light through the diffuser, controller or refractor to the ceiling with the members 14a,14b in the full line, lowermost position. Such an arrangement could also be used mounted on furniture or equipment such as tables, cabinets, desks and so on, or even wall mounted this way up for different lighting effects.

Figure 6:
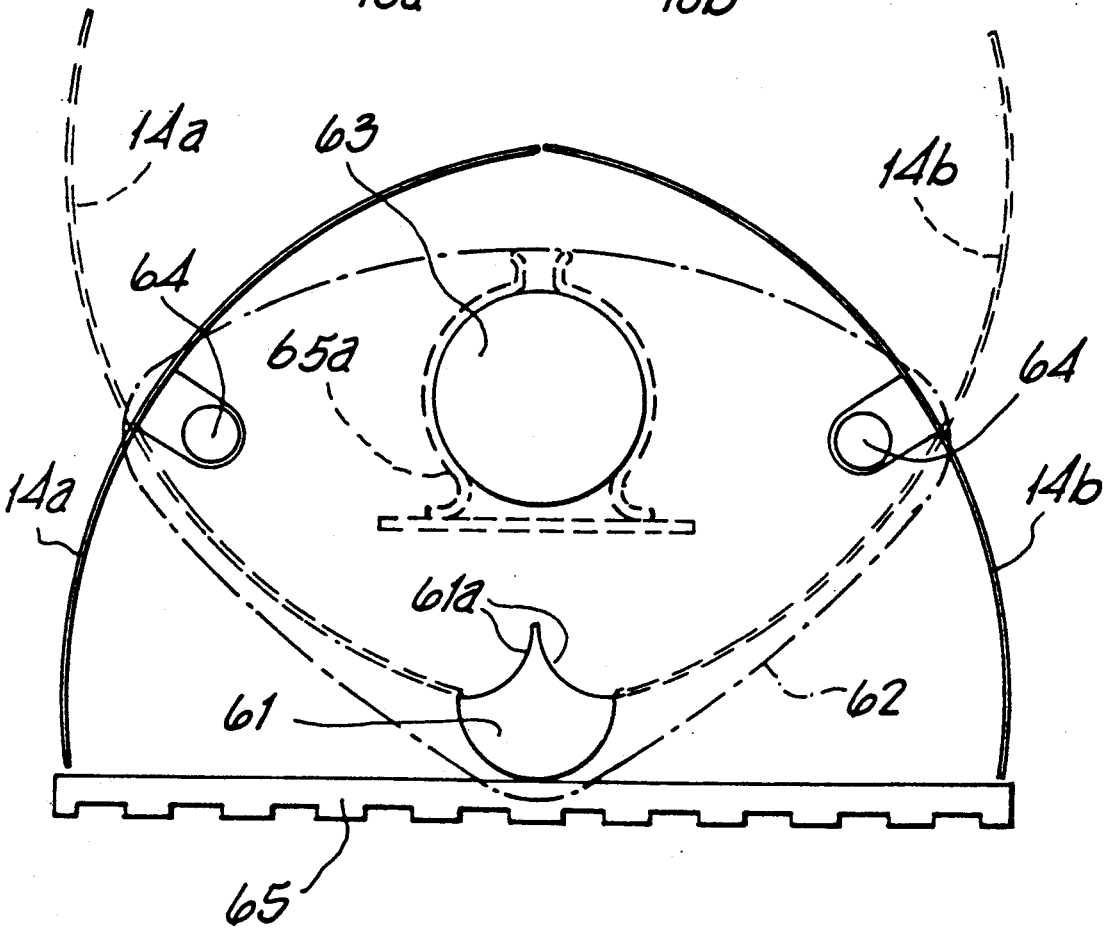
FIG. 6 is a diagrammatic cross-section of another fitting.

FIG. 6 illustrates, in diagrammatic cross-section, an arrangement in which a main longitudinal member 61 supports, via end caps 62 illustrated in dot-dash outline, the lamp 63 and pivots 64 for the members 14a,14b as well as the diffuser or refractor or controller 65. In this case, since all of the mechanism and supporting arrangement is below and/or at the ends of the lamp tube 63, there is an unobstructed light path to a ceiling and hence no shadows are cast thereon, when the members 14a,14b are in their lowermost, broken line position. In their uppermost, full line position, the members 14a,14b direct the light downwardly through the diffuser or controller 65.

The upper surfaces 61a of the member 61 may be adapted to form part of the upwardly directed reflector, when the members 14a,14b are in their broken line position by being finished in similar, reflective, fashion and being shaped to conform with the members 14a,14b when lowered to this position.

In another construction, the refractor or diffuser or controller 65 can be fitted entirely "internally" of the arrangement by being clipped to our otherwise supported entirely from the lamp tube 63 as illustrated in broken line at 65a.

Figure 7:
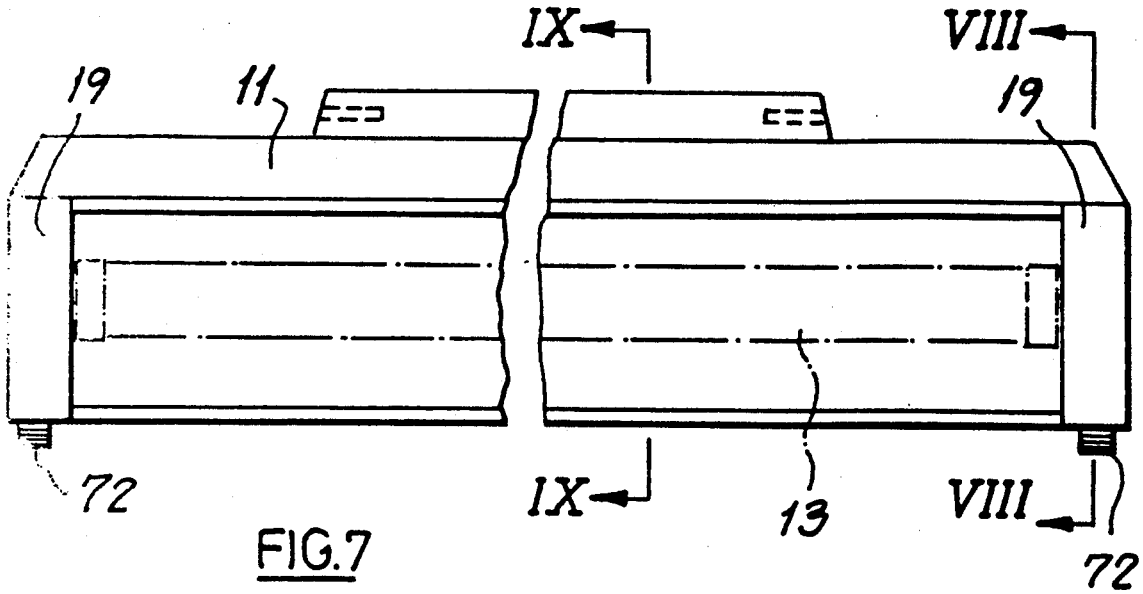
FIG. 7 is a side elevation of another fitting.
Figure 8:
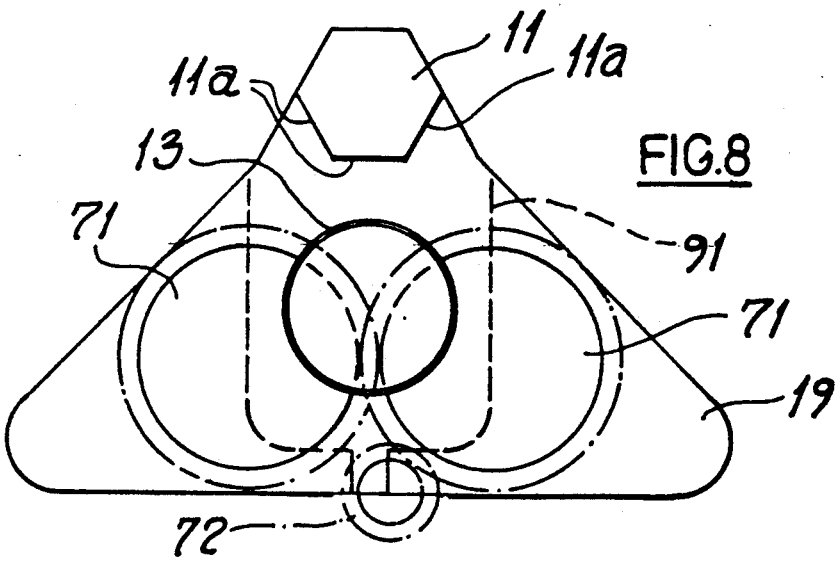
FIG. 8 is a section on the line VIII—VIII of FIG. 7.
Figure 9:
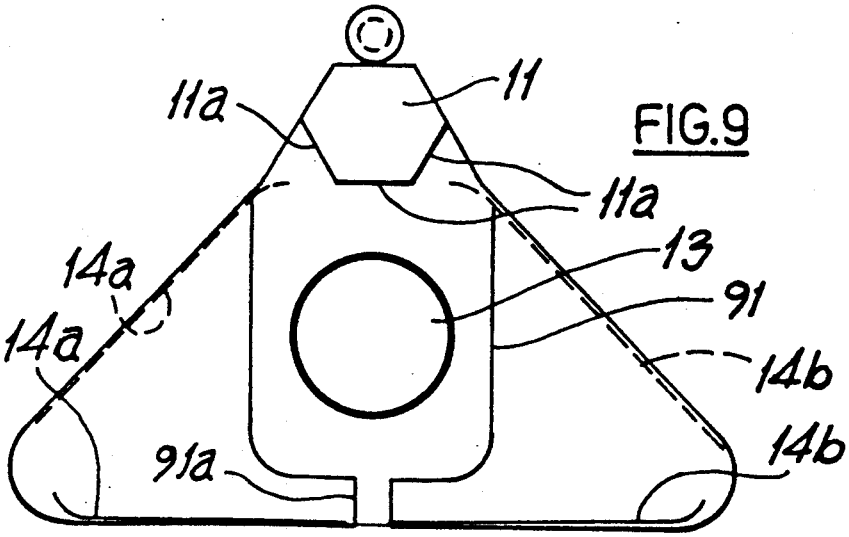
FIG. 9 is a section on the line IX—IX of FIG. 7.

The embodiment illustrated in FIGS. 7 to 9 has a hexagonal section support 11 with lower highly reflecting surfaces 11a. End caps 19 are moulded integrally with the support 11 and house meshing wheels 71 to which are attached reflectors 14a,,14b so that meshed rotation of the wheels 71 moves the reflectors 14a,14b from the lower full line position to the upper dashed line position. Such meshed rotation is effected by a thumb wheel 72 which meshes with only one of the wheels 71, being slightly off-centre for such purpose, or which meshes with another wheel coaxial with one of the wheels 71. A like arrangement may be provided at each end of the fitting so that the end cap arrangements can be identical.

In the full line position, the reflectors 14a,14b effectively cut off direct light in a downward direction when the fitting is used as a ceiling fitting, reflecting the light from the lamp 13—a fluorescent tube—up towards the ceiling 15. In the dashed line position, the reflectors 14a,14b direct the light downwardly for direct lighting below the fitting.

The reflectors 14a,14b should, of course, especially in the case of long fluorescent fittings, be of such rigidity that they can be turned from one end of the fitting without substantial flexure.

As seen in FIG. 9, the lamp 13 is surrounded by a diffused or filter 91 which, however, is open at the top. The diffuser or filter 91 is of generally U-shape but has a spine 91a which, in the lowered, indirect-lighting position of the reflectors 14a,14b separates the latter and is visible, when the lamp 13 is on, as a decorative white stripe lengthwise of the fitting, which allows a little diffused or filtered light through.

Instead of manual operation, the reflectors 14a,14b can of course be operated remotely as described elsewhere herein.

Figure 10:
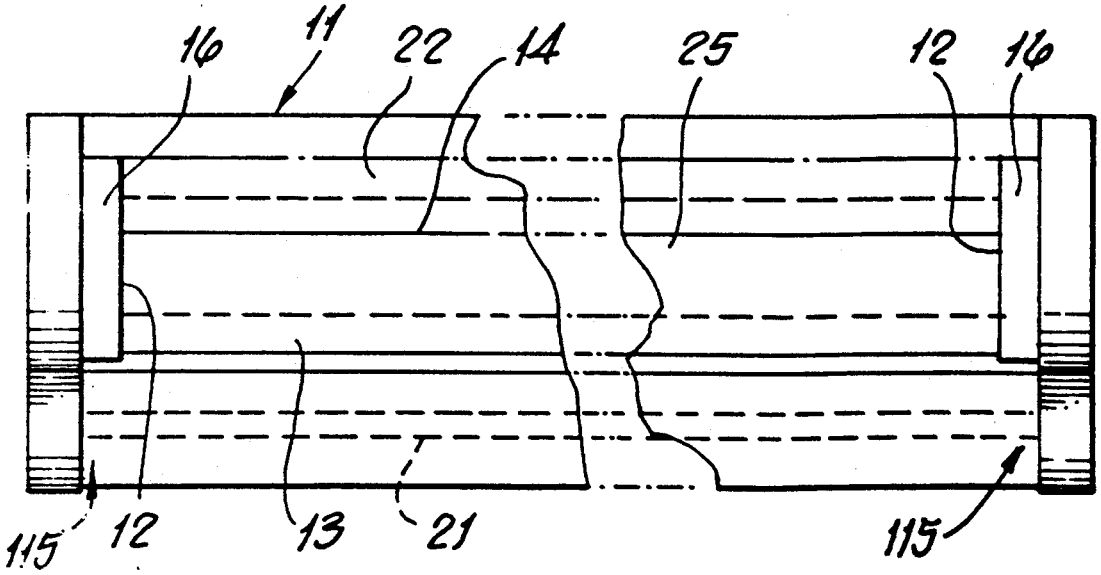
FIG. 10 is a side elevation of another embodiment.
Figure 11:
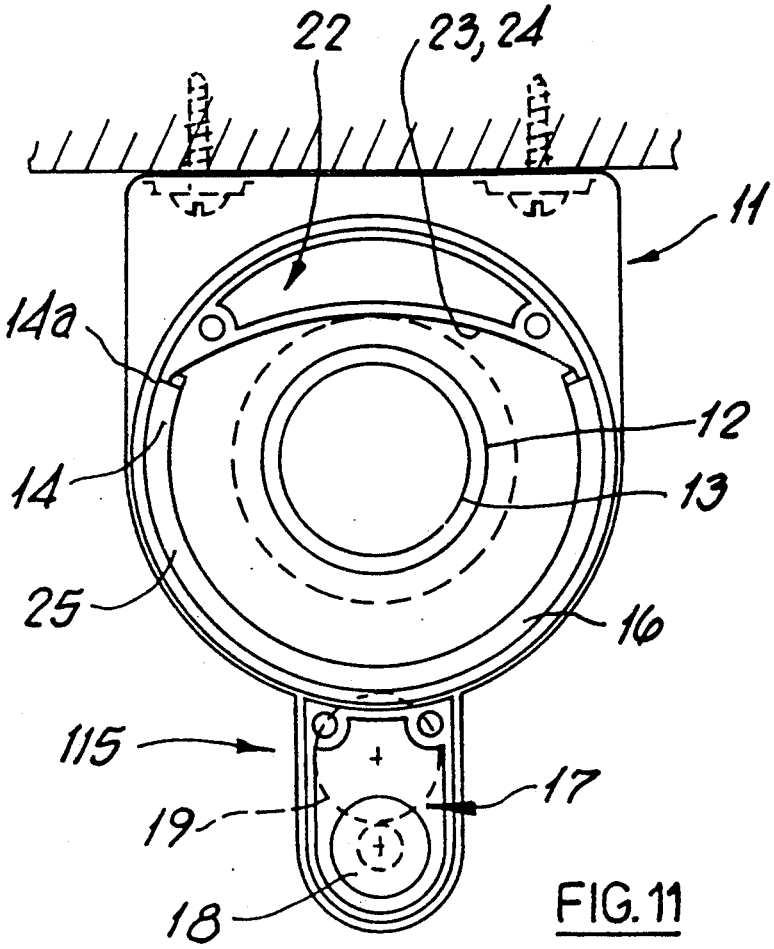
FIG. 11 is a section on the line XI—XI of FIG. 10.
Figure 12A:
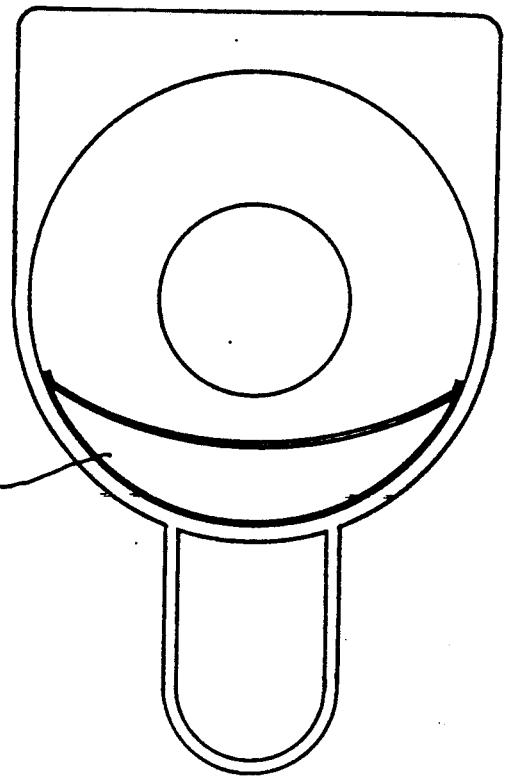
FIG. 12A, B and C are sections which illustrate different positions for the light directing means of the embodiment of FIGS. 10 and 11.
Figure 12C:
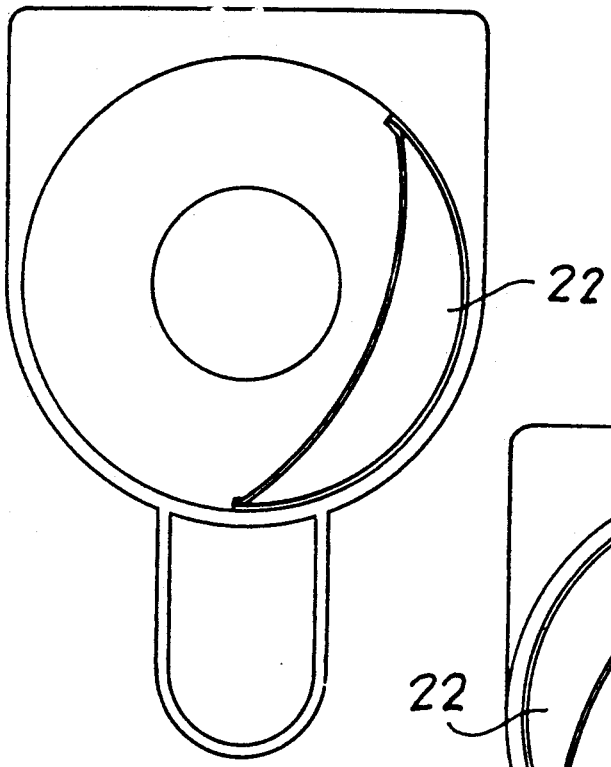
Figure 12C:
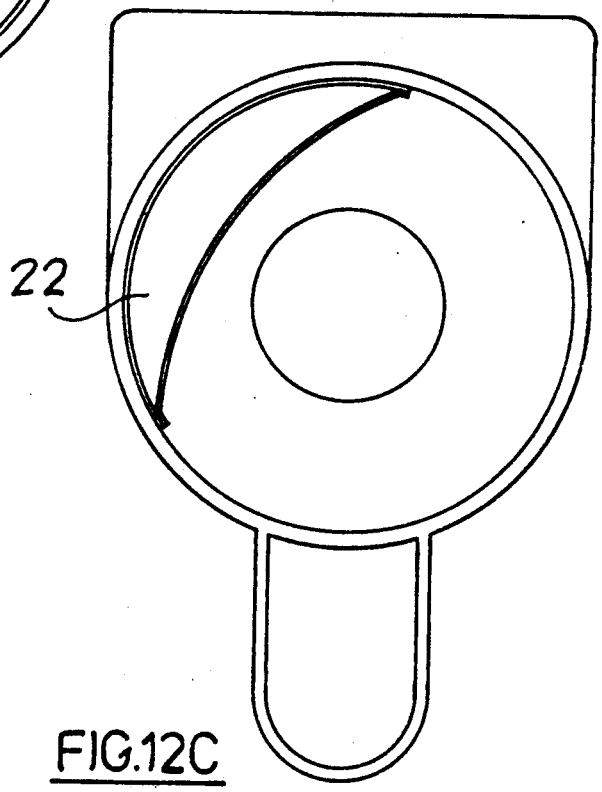

FIGS. 10–12 illustrate a space lighting fitting 11 comprising lamp holder means 12 for a fluorescent tube 13 and light directing means 14 supported for rotation about the lamp holder means 12, and adjustment means 15 adapted to rotate said light directing means 14 about said lamp holder means 12, the light directing means 14 and the lamp holder means 12 being coaxial.

The adjustment means 15 comprise rings 16 surrounding the lamp holder means 12 at each end of the tube 13 and fixed with respect to the light directing means 12, and locating means 17 to hold the rings 16 and hence the light directing means 14 in a set position. The locating means 17 comprise a motor 18 connected to drive the ring—which may be a stepping motor controlled e.g. by a wall switch or an infra-red signalling device or actuated by some automatic control arrangement such as a photocell which adjusts to suit ambient light conditions, or by a control signal for operating a plurality of lamps together, as in an office or factory, operating, for example, on a 0.5 to 10 volt d.c. superimposed on or sent separately from the a.c. mains supply. The motor 18 is connected to drive the ring by meshing with it via an idler 19.

The motor 18 acts on the rings 16 at both ends of the tube 13 via a lay shaft 21 extending parallel to the tube 13.

The light directing means 14 surround the tube 13 and comprise reflector means 22 which comprise an arcuate member 23 (which might have for example a silvered or an enamelled surface 24) having a lesser curvature than the cylinder (illustrated in broken line) which is the locus of its rotation about the axis of the tube 13 (hence of the lamp holder means 12). The light directing means 14 also comprise diffuser, prismatic controller or lensed refractor means 25, which are circular cylindrical and coaxial with their axis of rotation about the tube 13.

The light directing means 14 comprise a circular cylindrical shell 14a surrounding the tube 13 and having the reflector means 22 internally thereof.

In use, the space lighting fitting can be installed as by screwing it to a ceiling as shown in FIG. 2. The tube 13 is removable together with with light directing means for such installation and also of course for the replacement of fluorescent tubes. By "meshing" of course is also to be understood a frictional drive without gear-type teeth, which might facilitate the insertion and removal of the light directing means together with the fluorescent tube.

However, the diffuser, prismatic controller or lensed refractor means 25 can be made of a resilient plastics material so that it can be sprung into and out from engagement with the reflector means 22 to facilitate independent access.

The arrangements provides a simple and neat solution to the problem of adjustable lighting especially in situations where the lighting fittings are not readily accessible e.g. on a ceiling or high up on a wall. But, with or without the motor or other automatic or remote control arrangement, the fittings can be adapted for use in connection with standard lamps, desk lamps and lamps which are built in to domestic commercial or industrial furniture.

We claim:

1. A space lighting fitting for illuminating a space and comprising support means for attaching the fitting to a wall or ceiling surface which borders the space;

lamp holder means connected to the fitting for holding an elongated lamp therein, the lamp having a longitudinal axis;

light directing means adjustable between first and second positions giving direct and indirect light respectively to the space and comprising a generally turbular member extending along said longitudinal axis and rotatable thereabout;

said generally tubular member comprising a major arcuate portion of translucent material having a first inside curvature centered on said axis and a minor arcuate portion comprising a reflector and having a reflecting surface having a second inside curvature less than said first inside curvature, and, in said first position transmitting light from the lamp directly into said space through said translucent material and in said second position reflecting light from said lamp off of said wall or ceiling surface.

2. A space lighting fitting according to claim 1, in which said reflecting surface is silvered.

3. A space lighting fitting according to claim 1, in which said reflecting surface is enameled.

4. A space lighting fitting according to claim 1, in which said translucent material comprises prismatic controller means.

5. A space lighting fitting according to claim 1, in which said translucent material comprises lensed refractor means.

6. A space lighting fitting according to claim 1, comprising a motor connected to drive the generally tubular member in rotation.

7. A space lighting fitting according to claim 6, said generally tubular member and said motor having meshing gears.

8. A space lighting fitting according to claim 6, wherein said motor has a lay shaft extending along the generally tubular member and drivingly connected to the generally tubular member at each end thereof.

* * * * *